US005794697A

United States Patent [19]

Wolflick et al.

[11] Patent Number: 5,794,697

[45] Date of Patent: Aug. 18, 1998

[54] METHOD FOR INCREASING OIL PRODUCTION FROM AN OIL WELL PRODUCING A MIXTURE OF OIL AND GAS

[75] Inventors: John R. Wolflick, McKinney, Tex.; James L. Cawvey; Jerry L. Brady, both of Anchorage, Ak.; John R. Whitworth, Broken Arrow, Okla.; David D. Hearn, Anchorage, Ak.

[73] Assignee: Atlantic Richfield Company, Los Angeles, Calif.

[21] Appl. No.: 757,857

[22] Filed: Nov. 27, 1996

[51] Int. Cl.[6] ..... E21B 43/38; E21B 43/40

[52] U.S. Cl. ..... 166/265; 166/169; 166/306; 166/370

[58] Field of Search ..... 166/100, 105.5, 166/106, 169, 265, 306, 369, 370, 325

[56] References Cited

U.S. PATENT DOCUMENTS

| | | | |
|---|---|---|---|
| 4,378,047 | 3/1983 | Elliott et al. | 166/265 X |
| 4,531,593 | 7/1985 | Elliott et al. | 166/370 X |
| 4,610,793 | 9/1986 | Miller | 166/265 X |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,431,228 | 7/1995 | Weingarten et al. | 166/265 X |
| 5,482,117 | 1/1996 | Kolpak et al. | 166/265 |
| 5,605,193 | 2/1997 | Bearden et al. | 166/370 |

OTHER PUBLICATIONS

SPE 30637 New Design for Compact Liquid–Gas Partial Separation: Downhold and Surface Installations for Artificial Lift Application J.S. Weingarten, M.M. Kolpak, S.A. Mattison and M.J. Williamson; pp. 73–81.

The BiPhase Rotary Separator Turbine; Lance Hays Presented at the conference on Developments in Production Separation Systems, Jun. 21, 1995, London Biphase Energy Company.

*Primary Examiner*—George A. Suchfield
*Attorney, Agent, or Firm*—F. Lindsey Scott

[57] ABSTRACT

A system and a method for producing increased quantities of oil from an oil well producing a mixture of oil and gas through a well bore penetrating an oil bearing formation containing a gas cap zone and an oil bearing zone by separating at least a portion of the gas from the mixture of oil and gas downhole in an auger separator to produce a separated gas and an oil enriched mixture; compressing at least a portion of the separated gas downhole to a pressure greater than the pressure in the gas cap zone to produce a compressed gas; and, injecting the compressed gas into the gas cap and, recovering at least a major portion of the oil enriched mixture.

14 Claims, 7 Drawing Sheets

METHOD FOR INCREASING OIL PRODUCTION FROM AN OIL WELL PRODUCING A MIXTURE OF OIL AND GAS

BACKGROUND OF THE INVENTION

1. Field of the Invention

This invention relates to a method for increasing oil production from oil wells producing a mixture of oil and gas through a well bore penetrating an oil bearing formation containing a gas cap zone and an oil bearing zone by separating and reinjecting a portion of the gas into the gas cap zone prior to producing the mixture of oil and gas from the well bore.

2. Description of Related Art

In many oil fields the oil bearing formation comprises a gas cap zone and an oil bearing zone. Many of these fields produce a mixture of oil and gas with the gas to oil ratio (GOR) increasing as the field ages. This is a result of many factors well known to those skilled in the art. Typically the mixture of gas and oil is separated into an oil portion and a gas portion at the surface. The gas portion may be marketed as a natural gas product, reinjected to maintain pressure in the gas cap or the like. Further, many such fields are located in parts of the world where it is difficult to economically move the gas to market therefore the reinjection of the gas preserves its availability as a resource in the future as well as maintaining pressure in the gas cap.

Such wells may produce mixtures having a GOR of over 25,000. In such instances the mixture is less than 1% liquids. Typically a GOR from 2,500 to 4,000 is more than sufficient to carry the oil to the surface as a gas/oil mixture. Normally the oil is dispersed as finely divided droplets or a mist in the gas so produced. In many such wells quantities of water may be recovered with the oil. The term "oil" as used herein refers to liquids produced from a formation. The surface facilities for separating and returning the gas to the gas cap obviously must be of substantial capacity when such mixtures are produced to return sufficient gas to the gas cap to maintain oil production.

Typically, in such fields, gathering lines gather the fluids into common lines which are then passed to production facilities or the like where crude oil and condensate are separated and transported as crude oil. Natural gas liquids are then recovered from the gas stream and optionally combined with the crude oil and condensate. Optionally, a miscible solvent which comprises carbon dioxide, nitrogen and a mixture of hydrocarbons containing from one to about five carbon atoms may be recovered from the gas stream and used for enhanced oil recovery or the like. The remaining gas stream is then passed to a compressor where it is compressed for reinjection. The compressed gas is reinjected through injection wells, an annular section of a production well or the like back into the gas cap.

Clearly the size of the surface equipment required to process the mixture of gas and oil is considerable and may become a limiting factor on the amount of oil which can be produced from the formation because of capacity limitations on the ability to handle the produced gas.

It has been disclosed in U.S. Pat. No. 5,431,228 "Down Hole Gas-Liquid Separator for Wells" issued Jul. 11, 1995 to Weingarten et al and assigned to Atlantic Richfield Company that an auger separator can be used downhole to separate a gas and liquid stream for separate recovery at the surface. A gaseous portion of the stream is recovered through an annular space in the well with the liquids being recovered through a production tubing.

In SPE 30637 "New Design for Compact Liquid-Gas Partial Separation: Down Hole and Surface Installations for Artificial Lift Applications" by Weingarten et al it is disclosed that auger separators as disclosed in U.S. Pat. No. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantities of oil which can be produced from a subterranean formation which produces oil as a mixture of gas and liquids.

Accordingly a continuing search has been directed to the development of methods which can increase the amount of oil which may be produced from subterranean formations producing a mixture of oil and gas with existing surface equipment.

SUMMARY OF THE INVENTION

According to the present invention it has been found that increased quantities of oil can be produced from an oil well producing a mixture of oil and gas through a well bore penetrating an oil bearing formation containing a gas cap zone and an oil bearing zone by separating at least a portion of the gas from the mixture of oil and gas in the oil well to produce a separated gas and an oil enriched mixture; compressing at least a portion of the separated gas in the oil well to a pressure greater than the pressure in the gas cap zone to produce a compressed gas; injecting the compressed gas into the gas cap zone; and recovering at least a major portion of the oil enriched mixture from the oil well.

The invention further comprises a system for increasing oil production from an oil well producing a mixture of oil and gas through a well bore penetrating an oil bearing formation containing a gas cap zone and an oil bearing zone wherein the system comprises: an auger separator positioned in a first tubular member, the first tubular member being in fluid communication with the oil bearing zone and the surface; a compressor positioned in the first tubular member above the auger separator to receive a separated gas from the auger separator at a compressor inlet; a second tubular member positioned around the compressor and inside the first tubular member to provide a first annular passageway between the first tubular member and the second tubular member to receive the oil enriched mixture from the auger separator; and, a discharge passageway in fluid communication with a discharge from the compressor and an outlet through a wall of the first tubular member.

DESCRIPTION OF THE PREFERRED EMBODIMENTS

In the discussion of the Figures, the same numbers will be used to refer to the same or similar components throughout. Not all components of the wells necessary for the operation of the wells have been discussed in the interest of conciseness.

Figure 1:
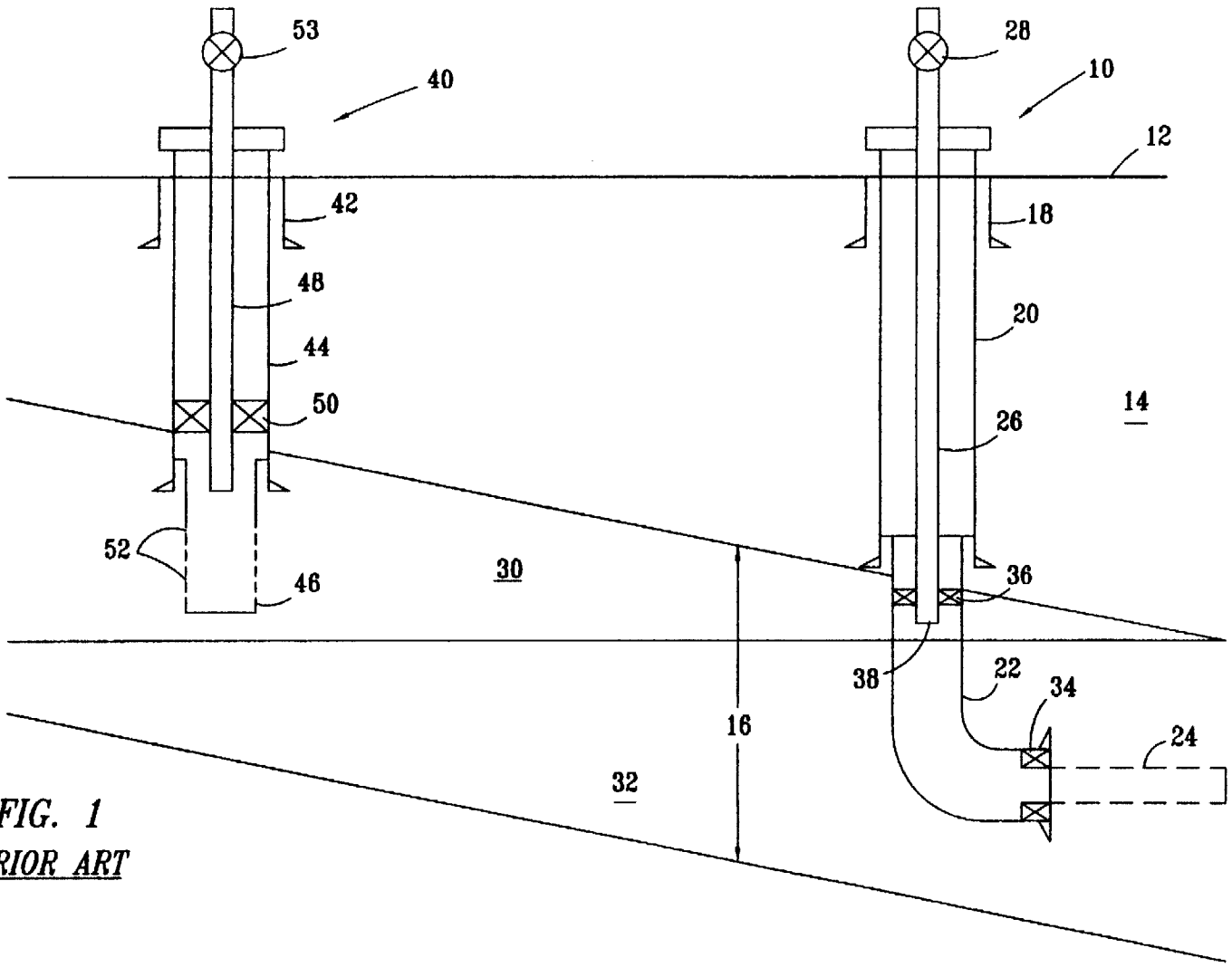
FIG. 1 PRIOR ART
FIG. 1 is a schematic diagram of a production well for producing a mixture of oil and gas from a subterranean formation and an injection well for injecting gas back into a gas cap in the oil bearing formation.

In FIG. 1 a production well 10 is positioned to extend from a surface 12 through an overburden 14 to an oil bearing formation 16. Production well 10 includes a first casing section 18, a second casing section 20, a third casing section 22 and a fourth casing section 24. The use of such casing sections is well known to those skilled in the art for the completion of oil wells. The casings are of a decreasing size and fourth casing 24 may be a slotted liner, a perforated pipe or the like. While production well 10 is shown as a well which has been curved to extend horizontally into formation 16 it is not necessary that well 10 include such a horizontal section and alternatively well 10 may comprise a vertical well into formation 16. Such variations are well known to those skilled in the art for the production of oil from subterranean formations.

Well 10 also includes a production tubing 26 for the production of fluids from well 10. Production tubing 26 extends upwardly to a wellhead 28 shown schematically as a valve. Wellhead 28 contains the necessary valving and the like to control the flow of fluids into and from well 10, production tubing 26 and the like.

Formation 16 includes a gas cap zone 30 above an oil bearing zone 32. Pressure in formation 16 is maintained by the gas in the gas cap and accordingly it is desirable in such fields to maintain the pressure in the gas cap as hydrocarbon fluids are produced from formation 16 by reinjecting the gas. The formation pressure may be maintained by water injection, gas injection or both. The reinjection of gas requires the removal of the liquids from the gas prior to recompressing the gas, and injecting it back into the gas cap. Typically the GOR of oil and gas mixtures recovered from such formations increases as the oil bearing zone drops as a result of the removal of oil from the oil bearing formation.

In well 10, packer 34 is used to prevent the flow of fluids in the annular space between fourth casing section 24 and third casing section 22. A packer 36 is used to prevent the flow of fluids in the annular space above packer 36 and between the outside of production tubing 26 and the inside of casings 20 and 22. Fluids from formation 16 can thus flow up production tubing 26 through wellhead 28 and to processing at the surface as described previously. Well 10 as shown produces fluids under the formation pressure and does not require a pump.

An injection well 40 is also shown. Injection well 40 comprises a first casing section 42, a second casing section 44, a third casing section 46 and an injection tubing 48. Flow upwardly between the outside of tubing 48 and the inside of casing 44 is prevented by a packer 50. Gas is injected into gas cap 30 through perforations 52 in third casing section 46. The flow of gases into well 40 is regulated by a wellhead 53 shown schematically as a valve.

The produced gas is thus returned to gas cap 30 where it maintains pressure in formation 16 and remains available for production and use as a fuel or resource at a later date if desired.

In wells which produce excessive amounts of gas the necessity for handling the large volume of gas at the surface can limit the ability of the formation to produce oil. The installation of sufficient gas handling equipment to separate the large volume of gas from the oil for use as a product or for return to the gas cap zone can be prohibitively expensive.

Figure 2:
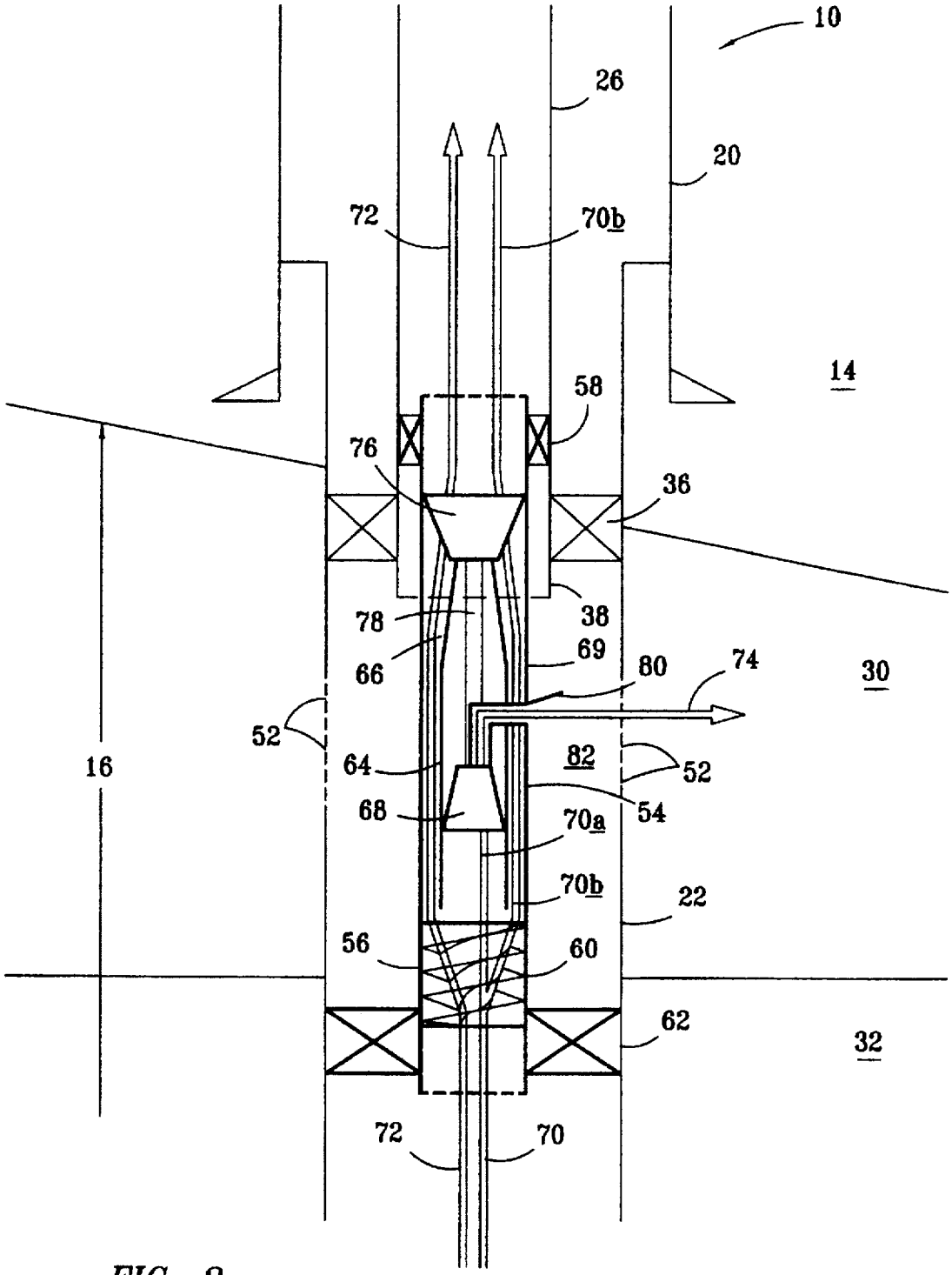
FIG. 2 is schematic diagram of an embodiment of the system of the present invention positioned in an existing well bore.

In FIG. 2 an embodiment of the present invention is shown which permits the separation and reinjection of at least a portion of the produced gas downhole. The embodiment shown in FIG. 2 comprises a tubular member 54 which is positioned as known to those skilled in the art in a lower end 38 of production tubing 26. The positioning of such tubular members by wire line or coil tubing techniques is well known to those skilled in the art and will not be discussed. A packer 58 or a nipple with a locking mandrel is positioned between the outer diameter of tubular section 54 and the inner diameter of production tubing 26 to prevent the flow of fluids in the annular space between tubular section 54 and production tubing 26.

As previously noted packer 36 is positioned to prevent the flow of fluids in the annular space between the outer diameter of production tubing 26 and the inner diameter of casing 22 and between the outer diameter of production tubing 26 and the inner diameter of casing 20.

An auger or other downhole separator 60 is positioned near a lower end 56 of tubular section 54. Auger separators of the type shown are more fully disclosed and discussed in U.S. Pat. No. 5,431,228, "Down Hole Gas Liquid Separator for Wells", issued Jul. 11, 1995 to Jean S. Weingarten et al which is hereby incorporated in its entirety by reference and in "New Design for Compact-Liquid Gas Partial Separation: Down Hole and Surface Installations for Artificial Lift Applications", Jean S. Weingarten et al, SPE 30637 presented Oct. 22–25, 1995. This reference is also hereby incorporated in its entirety by reference. Such auger separators are considered to be well known to those skilled in the art and are effective to separate at least a major portion of the gas from a flowing stream of gas and liquid by causing the fluid mixture to flow around a circular path thereby forcing the liquids to the outside by centrifugal force with the gases being recovered from a central discharge from the auger separator.

Auger separator 60 functions to separate gases from liquids contained in the mixture of oil and gas flowing from well 10. The flow of the gases is shown schematically by the arrows 70 with the flow of the liquids being shown schematically by the arrows 72. Typically at least 50 to 60% of the gas in the flowing stream is separated as gas in separator 60. The separated gas shown by arrow **70*a* is passed to a compressor 68 where it is compressed to a pressure greater than the pressure of the gas in gas cap 30 and passed as shown by an arrow 74 through a check valve or other suitable opening 80 into an annular space 82. Annular space 82 is a confined space defined by packer 36 and a packer 62 positioned between the outside of tubular section 54 and the inside of casing 22. The gas passed into annular section 82 then flows through perforations 52 in casing 22 and into gas cap 30. The liquids and the remaining gases flow as shown by the arrows, 70*b* and 72 around a tubular member 64 positioned to define an annular space 66 outside separator 60 and extending upwardly to a turbine 76. The gas and liquid mixture flowing through turbine 76 provides power to drive compressor 68 which is connected by a shaft 78 to turbine 76**.

In the operation of the device shown in FIG. 2 a mixture of oil and gas flows upwardly from formation 16 into tubular section 54 and is separated in separator 60 into a primarily gas stream and an oil enriched gas/liquid mixture. The gas stream is compressed and passed through opening 80 in the side of tubular member 54 and into gas cap 30. The remaining gas and liquid pass upwardly through a turbine 76 which is driven by the oil enriched gas/oil stream which is typically at a pressure more than sufficient to drive turbine 76 to power compressor 68. The gas and liquid then continue to the surface where they are recovered through well head 28 and passed to gas/liquid separation and the like. The gases may then be reinjected through an injection well, produced as a gas product or the like.

By the use of the device shown in FIG. 2 a portion of the gas is removed from the gas/liquid mixture and reinjected downhole without the necessity for passing the separated portion of the gas to the surface for treatment. This removal of a significant portion of the gas downhole relieves the load on the surface gas processing equipment since a smaller volume of gas is produced to the surface. In many fields GOR values as high as 25,000 are encountered. GOR values from 2,500 to 4,000 are generally more than sufficient to carry the produced liquids to the surface. A significant amount of the gas can thus be removed and reinjected down hole with no detriment to the production process. This significantly increases the amount of oil which can be recovered from formations which produce gas and oil in mixture which are limited by the amount of gas handling capacity available at the surface.

Figure 3:
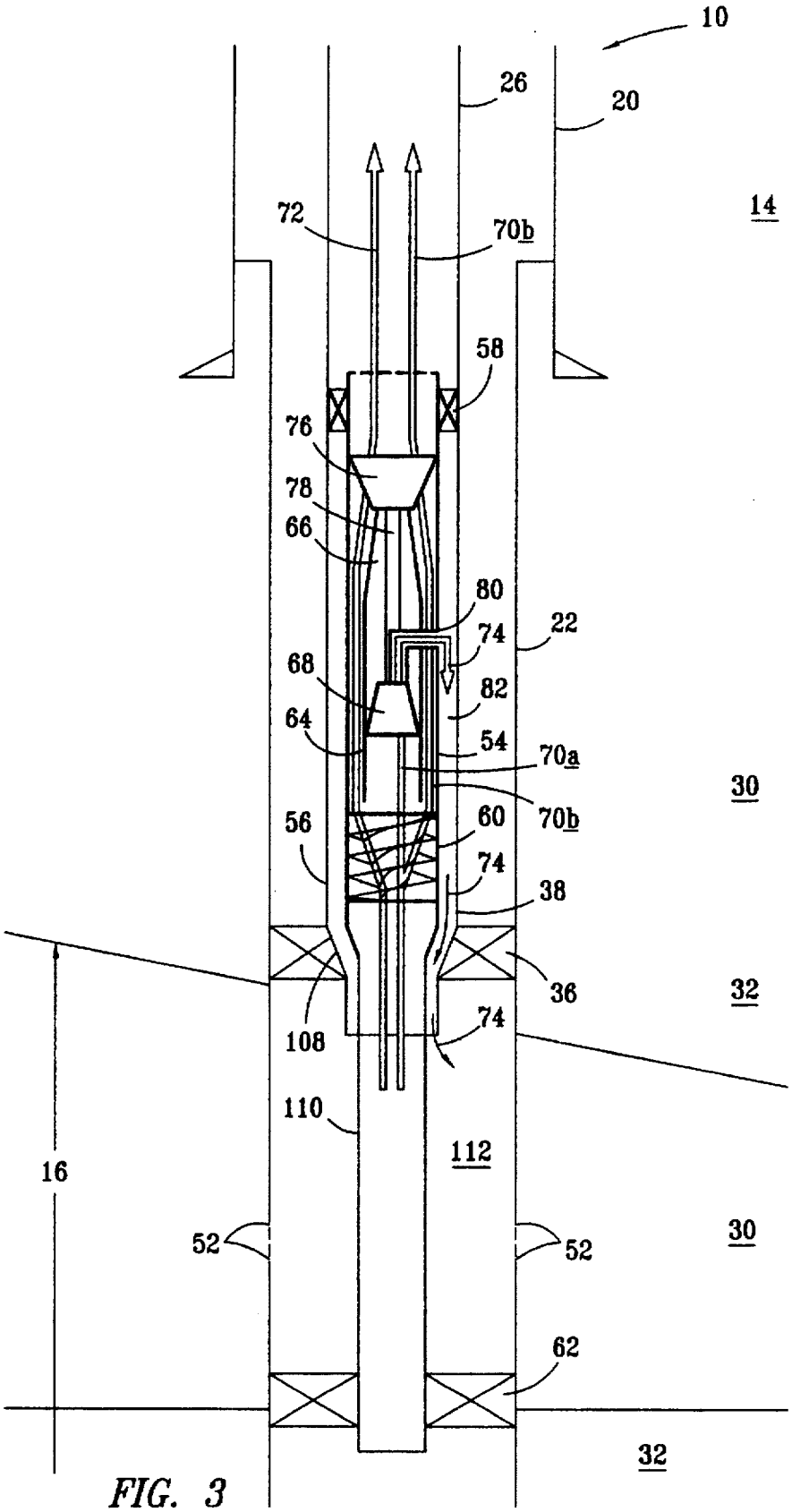
FIG. 3 is a schematic diagram of an alternate embodiment of the system of the present invention positioned in an existing well bore.

In FIG. 3 an alternate embodiment of the system of FIG. 2 is shown. The lower portion 38 of tubing 26 includes a reduced diameter portion 108 which is of a diameter smaller than the outer diameter of the tubular section 54. Fluids from the formation are produced through a tail pipe 110 in fluid communication with tubular section 54 via reduced diameter portion 108. Packer 36 is positioned at reduced diameter section 54 as shown and packer 62 is located between the outer diameter of tail pipe 110 and the inner diameter of casing 22 and is positioned to separate perforations 52 in gas cap 30 from perforations (not shown) in oil bearing zone 32. Packer 62 is a through tubing set packer or the like as known to the art. In FIG. 3 the separated gas is passed through opening 80 in tubular section 54 into annular space 82 which in FIG. 3 is defined by the outer diameter of tubular member 54, the inner diameter of tubing 26 and packer 58. The gas flows as shown by arrows 74 out of annular space 82 and into a space 112 above packer 62 and through perforations 52 into gas cap 30 in formation 16.

Figure 4:
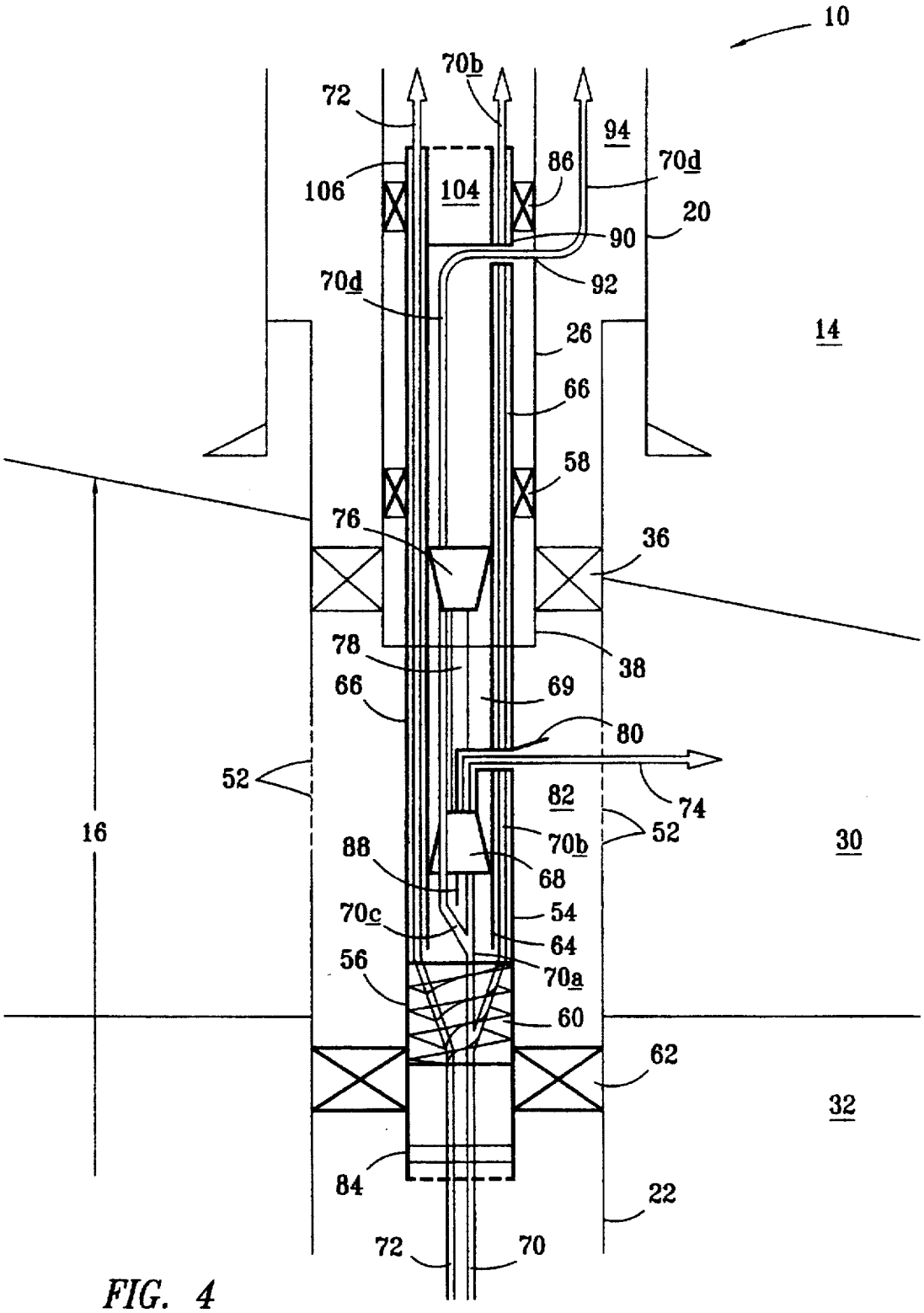
FIG. 4 is a schematic diagram of an alternate embodiment of the system of the present invention positioned in an existing well bore.

In FIG. 4 an alternate embodiment of the present invention is shown. In FIG. 4 annular space 66 extends past turbine 76 and beyond a plug 104 in an upper end 106 of tubular section 54. This stream is then passed to the surface for recovery as a gas/oil mixture. The gas separated in separator 60 is split by a splitter 88 shown schematically beneath compressor 68 and passed through an annular space (not shown) positioned around compressor 68. The flow of this gas is shown schematically by an arrow 70c. The portion of the gas separated in splitter 88 flows upwardly to turbine 76 which in this embodiment is driven by the gas. This embodiment enables the use of a primarily gaseous stream to drive turbine 76 and does not substantially reduce the pressure of the oil enriched oil/gas mixture passing through tubing 26 to the surface. The gas passing through turbine 76 loses substantial energy in turbine 76 and is at a resulting reduced pressure which is not sufficient to reinject this gas into the oil enriched mixture in tubing 26. Accordingly this stream may be passed upwardly as shown by arrow **70*d* and outwardly through an opening 90 in tubular section 54 and an opening 92 in production tubing 26 into an annular space 94 defined by the outside of production tubing 26 and the inside of second casing section 20. This gas may then be passed to the surface through the annular space 94 or may be combined with the enriched oil mixture at a level in the well where the gas pressure is sufficient for a recombination of these streams. This embodiment requires an additional packer 86 positioned between the top of tubular section 54 and the inside of production tubing 26. Because this embodiment involves annular flow a subsurface safety valve 84** is required.

This embodiment functions to accomplish the same objectives achieved in FIG. 2 with the primary differences being that the pressure of the oil/gas mixture flowing up the production tubing to the surface is not reduced by driving a turbine and the turbine is operated with a primarily gaseous stream.

Figure 5:
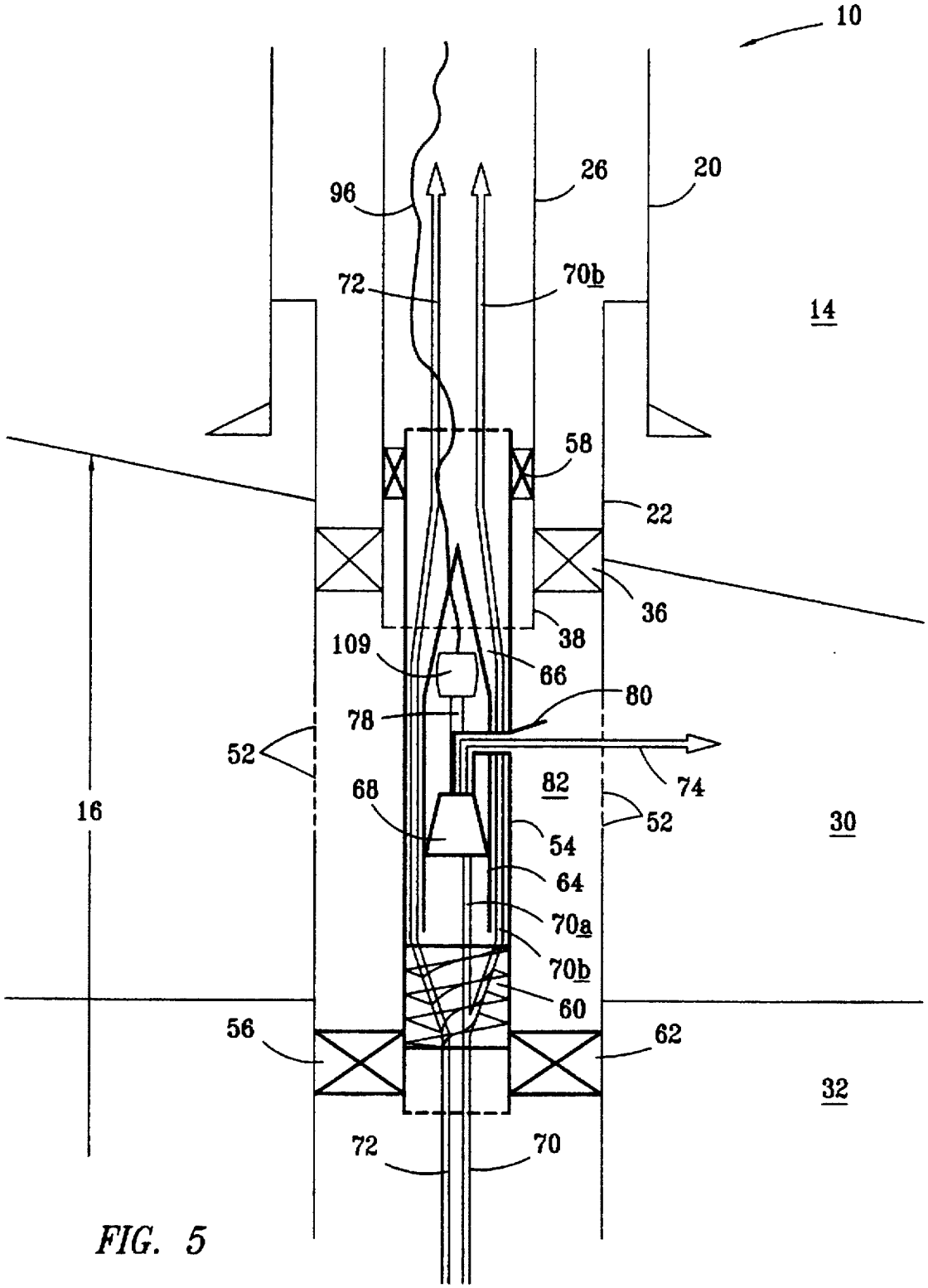
FIG. 5 is a schematic diagram of an alternate embodiment of the system of the present invention positioned in an existing well bore.

In FIG. 5 an alternate embodiment is shown wherein electrical power is supplied via a wire 96 to drive an electric motor 109 which drives compressor 68 via shaft 78. The embodiment in FIG. 5 functions as described in connection with FIG. 2 except that no downhole turbine is used since the compressor is driven by electrical power.

Figure 6:
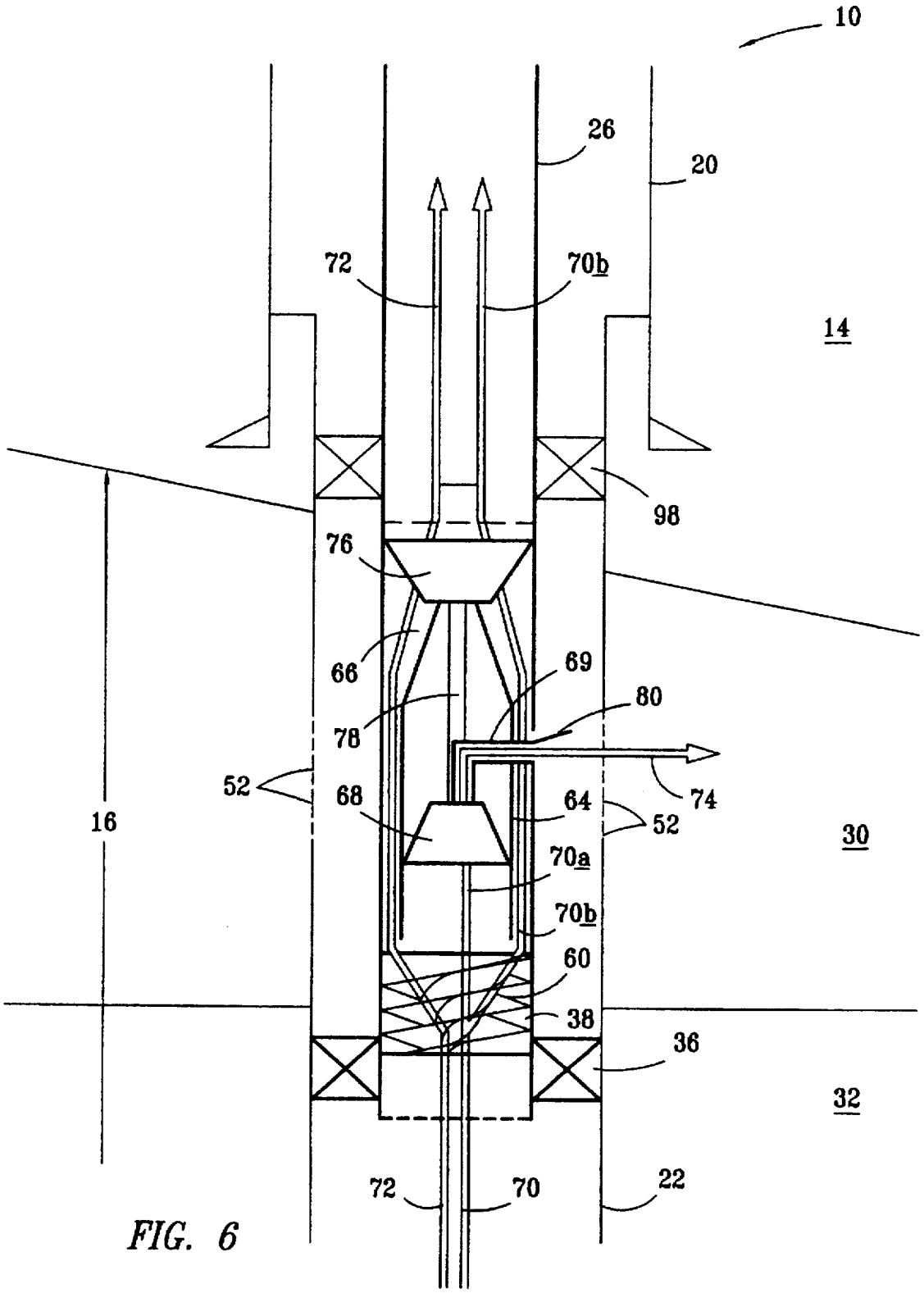
FIG. 6 is a schematic diagram of an embodiment of the system of present invention positioned in a production tubing in a well bore completed with the system of the present invention in place.

In the embodiments shown in FIG. 2, FIG. 3, FIG. 4 and FIG. 5 tubular section 54 is positioned in an existing production tubing by wire line or coil tubing techniques. In FIG. 6 an embodiment corresponding to FIG. 2 is shown wherein the compressor and turbine are installed in a new well. When installed in a new well or when installed with the production tubing 26 one less packer is required since tubular section 54 is formed as a lower portion of production tubing 26. In other respects the apparatus shown in FIG. 6 functions as described in conjunction with FIG. 2.

Figure 7:
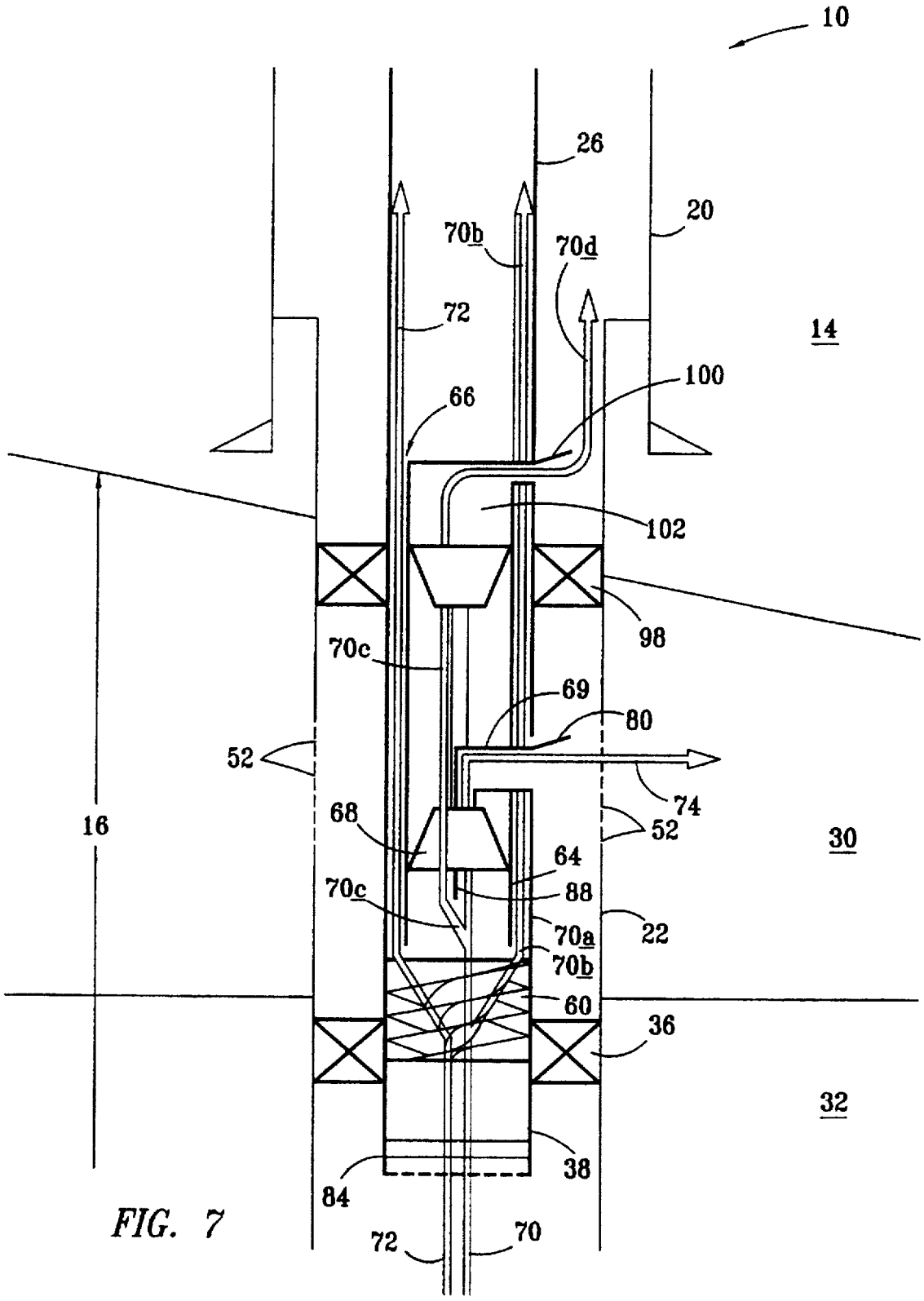
FIG. 7 is a schematic diagram of an alternate embodiment of the system of the present invention positioned in a well tubing in a well completed with the system of the present invention in place.

FIG. 7 corresponds to the embodiment shown in FIG. 4 except that the embodiment shown in FIG. 7 has also been installed with production tubing 26. This embodiment also requires one less packer but otherwise functions as described in conjunction with FIG. 4. Tubular section 54 is formed as a lower portion of production tubing 26. While not shown, an embodiment corresponding to the embodiment shown in FIG. 5 could also be used in conjunction with a new completion.

Auger separators as discussed are considered to be well known to those skilled in the art and have been demonstrated to be effective to separate 50 to 60% of the gas contained in a gas/liquid mixture. By the use of these separators which are readily configured for positioning in a well through a production tubing, the gas/liquid mixture can be at least partially separated into a gas stream and an oil enriched mixture. As discussed the produced fluids are generally at a pressure sufficient to drive a compressor via a turbine to reinject a significant portion of the gas downhole. This results in a greatly reduced quantity of gas which must be separated and compressed by the gas processing equipment at the surface and permits the production of added quantities of oil from the formation with a given gas handling capacity. This effectively increases the rate of oil production from the subterranean formation producing a mixture of oil and gas.

Well completions of the type shown in the Figures are considered to be well know to those skilled in the art and will not be discussed in detail.

The investment to install the system of the present invention in a plurality of wells to reduce the gas produced from a field is substantially less than the cost of adding the additional separation and compression equipment at the surface. It also requires no fuel gas to drive the compression equipment since the pressure of the flowing fluids can be used for this purpose. It also permits the reinjection of selected quantities of gas into the gas cap downhole from groups of wells, or individual wells from which oil production has become limited by reason of the capacity of the lines to convey produced fluids away from the well thereby permitting increased production for such wells. It can also make certain formations which have previously been uneconomical to produce because of the high gas/oil ratio economical to produce because of the ability to reinject the gas downhole.

It is considered that the system of the present invention can be readily assembled and installed by techniques well known to those skilled in the art by using off-the-shelf equipment available to the art.

The present invention has thus provided a method and an apparatus for the recovery of additional oil from an oil bearing formation which produces a mixture of oil and gas at a greatly reduced cost by comparison to the previously used methods and equipment.

Having thus described the invention by reference to certain of its preferred embodiments it is noted that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention we claim:

1. A method for increasing oil production from an oil well producing a mixture of oil and gas through a well bore penetrating an oil-bearing formation containing a gas cap zone and an oil-bearing zone, the method comprising:

a) separating at least a portion of the gas from the mixture of oil and gas in the oil well in an auger separator positioned in a tubular member in fluid communication with the oil-bearing formation and a tubing member extending to a surface to produce a separated gas and an oil-enriched mixture;

b) driving a turbine positioned in the tubular member and connected to a compressor in the tubular member with the oil-enriched mixture and compressing at least a portion of the separated gas in the oil well to a pressure greater than a pressure in the gas cap zone to produce a compressed gas;

c) injecting the compressed gas into the gas cap zone; and d) recovering at least a major portion of the oil-enriched mixture.

2. A system for increasing oil production from an oil well producing a mixture of oil and gas through a well bore penetrating an oil-bearing formation containing a gas cap zone and an oil-bearing zone, the system comprising:

a) an auger separator positioned in a first tubular member, the first tubular member being in fluid communication with the oil-bearing zone and a surface;

b) a compressor positioned in the first tubular member above the auger separator to receive a separated gas from the auger separator at a compressor inlet;

c) a second tubular member positioned around the compressor and inside the first tubular member to provide a first annular passageway between the first tubular member and the second tubular member to receive an oil-enriched mixture from the auger separator; and d) a discharge passageway in fluid communication with a discharge from the compressor and an outlet through a wall of the first tubular member.

3. The system of claim 2 wherein the compressor is electrically powered.

4. The system of claim 2 wherein the outlet through the wall of the first tubular member comprises a check valve to prevent the flow of fluids into the compressor through the passageway.

5. The system of claim 2 wherein the first tubular member is positioned in a lower end of a tubing string extending to the surface.

6. The system of claim 2 wherein the system includes a turbine in the first tubular member and connected to the compressor.

7. The system of claim 6 wherein the first annular passageway is in fluid communication with an inlet to the turbine.

8. The system of claim 6 wherein the first annular space is in fluid communication with the surface and wherein a flow splitter is positioned in fluid communication with an auger separator outlet to direct a first portion of the separated gas to a second annular space positioned around the compressor and in fluid communication with a turbine inlet and the flow splitter and a second portion of the separated gas to a compressor inlet.

9. The system of claim 8 wherein the first tubular member includes an outlet for the separated gas discharged from the turbine.

10. The system of claim 2 wherein the first tubular member is positioned in a lower end of a tubing string extending to the surface in a cased well and wherein a first packer is positioned to close an annular space between the lower end of the tubing string and the well casing and wherein a second packer is positioned to close an annular space between the first tubular member and the well casing with the discharge passageway and perforations through the well casing being positioned between the first and the second packer.

11. The system of claim 2 wherein the first tubular member comprises the lower end of a tubing string extending to the surface in a cased well and wherein a first packer is positioned to close an annular space between the tubing string and the well casing above the discharge passageway and perforations in the well casing and a second packer is positioned to close the annular space below the discharge inlet and the perforations.

12. A method for increasing oil production from an oil well producing a mixture of oil and gas through a wellbore penetrating an oil-bearing formation containing a gas cap zone and an oil-bearing zone, the method comprising:

a) separating at least a portion of the gas from the mixture of oil and gas in the oil well in an auger separator positioned in a tubular member positioned in fluid communication with the oil-bearing formation and a tubing member extending to a surface to produce a separated gas and an oil-enriched mixture;

b) driving a turbine positioned in the tubular member and connected to a compressor in the tubular member with a first portion of the separated gas to compress a second portion of the separated gas to a pressure greater than a pressure in the gas cap zone to produce a compressed gas;

c) injecting the compressed second portion of the separated gas into the gas cap; and d) recovering at least a major portion of the oil-enriched mixture.

13. The method of claim 12 wherein the first portion of the separated gas is combined with the oil-enriched mixture.

14. A method for increasing oil production from an oil well producing a mixture of oil and gas through a wellbore penetrating an oil-bearing formation containing a gas cap zone and an oil-bearing zone, the method consisting essentially of:

a) separating at least a portion of the gas from the mixture of oil and gas in the oil well in an auger separator positioned in a tubular member in fluid communication with the oil-bearing formation and a tubing member extending to a surface;

b) compressing at least a portion of the separated gas in the oil well with an electrically powered compressor to a pressure greater than a pressure in the gas cap zone to produce a compressed gas;

c) injecting the compressed gas into the gas cap zone; and d) recovering at least a major portion of the oil-enriched mixture.

* * * * *